United States Patent [19]

Toyoda

[11] 4,454,394

[45] Jun. 12, 1984

[54] CIRCUIT BREAKER HAVING A PARALLEL RESISTOR

[75] Inventor: Mitsuru Toyoda, Yokohama, Japan

[73] Assignee: Tokyo Shibaura Denki Kabushiki Kaisha, Kawasaki, Japan

[21] Appl. No.: 312,728

[22] Filed: Oct. 19, 1981

[30] Foreign Application Priority Data

Oct. 25, 1980 [JP] Japan ..... 55-149905

[51] Int. Cl.[3] ..... H01H 9/40

[52] U.S. Cl. ..... 200/145; 200/144 AP; 200/148 A

[58] Field of Search ..... 200/145 R, 146 R, 148 A, 200/148 D, 144 AP; 361/6, 8, 10, 13

[56] References Cited

U.S. PATENT DOCUMENTS 3,358,105 12/1967 Barker et al. ..... 200/145 X
3,538,277 11/1970 Phillips ..... 361/13 X

FOREIGN PATENT DOCUMENTS 49-21508 6/1974 Japan .
50-21266 3/1975 Japan .
51-93367 8/1976 Japan .

*Primary Examiner*—Elliot A. Goldberg
*Assistant Examiner*—Morris Ginsburg
*Attorney, Agent, or Firm*—Oblon, Fisher, Spivak, McClelland & Maier

[57] ABSTRACT

A circuit breaker for a transmission line includes a plurality of main interrupters and a plurality of parallel resistor interrupters. In order to reduce an overvoltage on the transmission line, the main interrupters are closed at slightly different times.

6 Claims, 7 Drawing Figures

CIRCUIT BREAKER HAVING A PARALLEL RESISTOR

BACKGROUND OF THE INVENTION

1. Field of the Invention

This invention relates generally to circuit breakers for transmission lines and more particularly to circuit breakers for transmission lines having parallel resistor interrupters for reducing an overvoltage condition which appears on the transmission lines when it is connected.

2. Description of the Prior Art

If an overvoltage appears on a transmission line or bus bar to which circuit breakers are attached, it is desirable to reduce the overvoltage which appears on the transmission line when it is connected. In order to reduce the overvoltage, prior art circuit breakers have utilized a plurality of main interrupters connected in series between end terminals with parallel resistor interupters connected through parallel resistors in series between the end terminals and in parallel with the main interrupters. The connections between the interrupters are changed so as to change the value of the resistance in parallel with the main interrupters. In prior art devices, the connections are changed at least twice so as to present at least two values of resistance before the main interrupters are closed.

Various mechanical mechanisms have been used in the prior art to chronologically change the connections between the interrupters so as to change the resistance. Mechanisms of this sort are shown in FIGS. 1 and 2. FIG. 1 shows a circuit diagram of a monopole multi-gap circuit breaker according to the prior art. As shown in FIG. 1, a multi-gap circuit breaker has 2 main interrupters 1 connected in series between end terminals 8 and 9. Parallel resistor interrupters 2, 3 are connected respectively in parallel with each corresponding main interrupter 1. Parallel resistors 6*a* and 6*b* are connected in series with one another and the parallel resistor interrupters 2 between the end terminals 8 and 9. The parallel resistor interrupters 3 are connected from a point between parallel resistors 6*a* and 6*b* to each end terminal 8 and 9. The point between the parallel resistor interrupters 2 and the point between the main circuit interrupters 1 are connected electrically with each other. In operation, the main interrupters 1 and parallel resistor interrupters 2, 3 are mechanically connected to a driving device 7 through a rod 4 and insulating rods 5 and 10. Interrupters 3 are mechanically but not electrically interconnected. Insulating rods 5 are used for closing and opening the parallel resistor interrupters 3 since the interrupter 3 should be insulated from the rod 4 which is connected mechanically and electrically to the main circuit interrupters 1 and parallel resistor interrupters 2.

During the operation of the circuit breaker, the main interrupter 1 and parallel resistor interrupters 2, 3 are so arranged that the interrupters 1, 2, 3 will close at slightly different moments of time. However, the interrupters which have the same reference numerals will close at the same time. When the circuit breaker is closing, at a first stage the parallel resistor interrupters 2 are closed by the insulating rod 10 which is operated by the driving device 7. The parallel resistors 6*a*, 6*b* are then connected directly to the end terminals 8, 9. The ohmic value between the end terminals 8 and 9 amounts to 2(Ra+Rb), wherein Ra is the ohmic value of the parallel resistor 6*a* and Rb is the ohmic value of the parallel resistor 6*b*. At a second stage, the parallel resistor interupters 3 are closed by the rod 4, insulating rods 5 and insulating rod 10 which are connected mechanically with each other. The parallel resistors 6*a* are connected directly to the end terminals 8 and 9. The ohmic value between the end terminals 8, 9 amounts to 2Ra. At the final stage the main interrupters 1 are closed by the rod 4 and the insulating rod 10. The construction of the circuit-breaker shown in FIG. 1 needs 2 parallel resistor interrupters 2, 3 and the insulating rods 5 which operate the parallel resistor interrupters 3. The mechanism which makes the interrupters 1, 2, 3 close at slightly different moments of time has low reliability, due to the complicated nature of the connecting mechanism between the movable contacts of the interrupters 1, 2 and 3.

FIG. 2 shows a circuit diagram of a monopole multi-gap circuit breaker according to the prior art. As shown in FIG. 2, a multi-gap circuit breaker has 2 main interrupters 1 connected in series between the end terminals 8 and 9. Parallel resistor interrupters 2 and 3 are connected respectively in parallel with each corresponding main interrupter 1 between the end terminals 8 and 9. The parallel resistors 11 are inserted between the parallel resistor interrupters 2. The parallel resistors 12 are inserted between the parallel resistor interrupters 3. The point between main breakers 1 and the points between the parallel resistors 11, 12 are connected electrically. The distance $L_1$ between the contacts of the parallel resistor interrupters 2 is smaller than the distance $L_2$ between the contacts of the parallel resistor interrupters 3. The ohmic value of parallel resistor 11 is greater than that of parallel resistor 12. The interrupters 1, 2, 3 are so arranged that they will close at slightly different moments of time. When the circuit breaker closes, at the first stage, the parallel resistor interrupters 2 are closed; at the second stage, the parallel resistor interrupters 3 are closed; and at the final stage, the main interrupters 1 are closed. The resistance at the first stage is therefore greater than at the second stage. The closing time lag between the parallel resistor interrupters 2 and 3 depends on the difference between $L_1$ and $L_2$. The construction of the circuit breaker shown in FIG. 2 requires parallel resistors 11 and 12 which have different ohmic values and parallel resistor interrupters 2 and 3 for each main interrupter 1. It is inevitable that the driving devices 7 must drive the interrupters 1, 2, 3 and therefore have low reliability.

SUMMARY OF THE INVENTION

Accordingly, one object of this invention is to provide a new and improved circuit breaker for a transmission line.

Another object of this invention is to provide a circuit breaker which reduces an overvoltage situation.

A further object of the invention is to provide a circuit breaker having a connecting mechanism of high reliability.

A still further object of this invention is to provide a circuit breaker having a small number of parallel resistor interrupters, simple driving mechanism and high reliability.

Another object of the invention is to provide a circuit breaker having parallel resistor interrupters which are closed before main interrupters which are closed at different times.

Another object of the invention is to provide a circuit breaker which may consist of a series of units, with each unit having main interrupters which close at times different from other units.

Briefly, these and other objects of the invention are achieved by providing a circuit breaker having a number of main interrupters in series between the end terminals with parallel resistors and parallel interrupters connected in parallel to the main interrupters. A driving device operates the closing of the various interrupters. Each main interrupter has a different closing time which occurs after the closing of the parallel resistor interrupters. The result is a reduction of overvoltage which appears on the transmission line when it is closed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
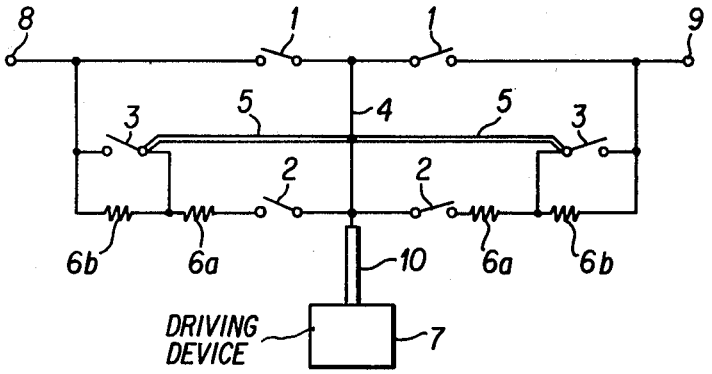
FIG. 1 PRIOR ART
FIGS. 1 and 2 are circuit diagrams of prior art circuit breakers having main interrupters and parallel resistor interrupters.
Figure 2:
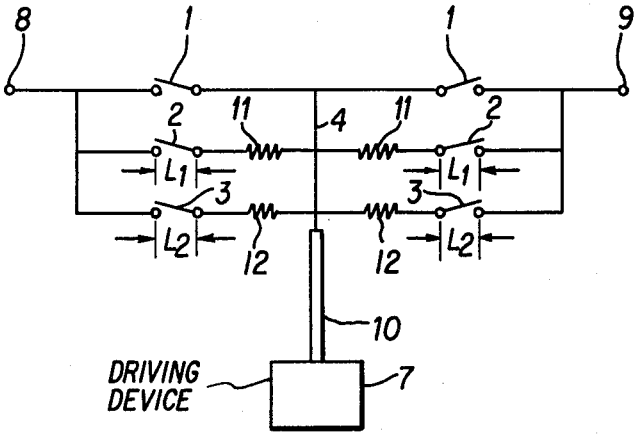
FIG. 2 PRIOR ART
Figure 3:
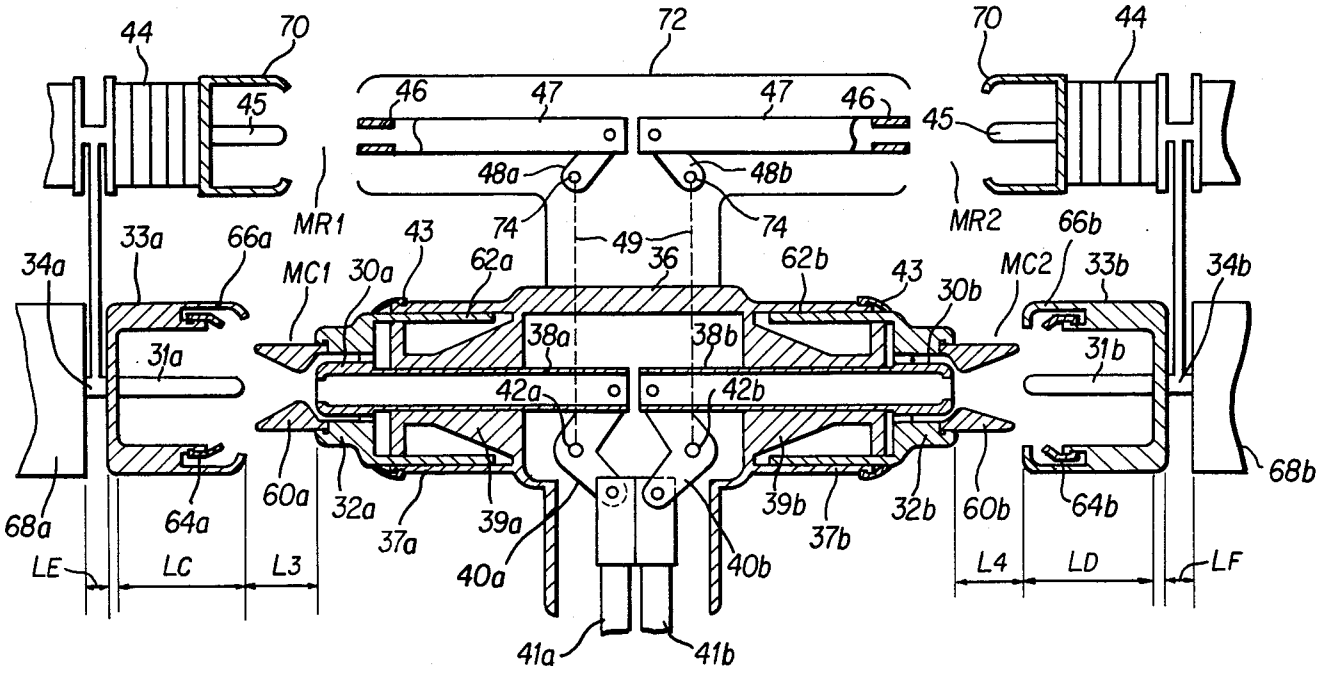
FIG. 3 is a sectional view of a first embodiment of the present invention.

Referring now to the drawings, wherein like reference numerals designate identical or corresponding parts throughout the several views, and more particularly to FIG. 3 thereof, wherein a sectional view of a first embodiment of the instant invention is shown as including main interrupters, MC1 and MC2, and parallel resistor interrupters, MR1 and MR2. The main interrupter MC1 consists of a movable contact 30*a* and a stationary contact 31*a*. The main interrupter MC2 which is connected with the interrupter MC1 in series consists of a movable contact 30*b* and a stationary contact 31*b*. Auxiliary movable contacts 32*a*, 32*b* surround the movable contacts 30*a*, 30*b* and are connected with the movable contacts 30*a*, 30*b* electrically and mechanically. Nozzles 60*a*, 60*b* of insulating material are positioned outside of the auxiliary movable contacts 30*a*, 30*b*, so that the arc between contacts 30*a*, 30*b* and 31*a*, 31*b* is blasted out when the main interrupters MC1, MC2 are opened. Puffer cylinders 62*a*, 62*b* extend longitudinally from the auxiliary movable contacts 32*a*, 32*b* in a direction away from the nozzles 60*a*, 60*b* and are guided over the supporting materials 39*a*, 39*b*, during the opening motion to form puffer chambers with supporting materials 39*a*, 39*b*. These materials project from a center casing 36 and are connected with the puffer cylinders 62*a*, 62*b* which are connected with the auxiliary movable contacts 32*a*, 32*b*, electrically and mechanically, via a plurality of resilient fingers 43 which are engaged with supporting materials 37*a*, 37*b* which project from the center casing 36. The stationary contacts 31*a*, 31*b* are engaged with stationary contact supporting parts 33*a*, 33*b*. At the top of the stationary contact supporting parts 33*a*, 33*b*, a plurality of resilient fingers 64*a*, 64*b* are shielded by shields 66*a*, 66*b* to insure a smooth electric field around contacts 30*a*, 31*a*, and 30*b*, 31*b*.

The stationary contacts 31*a*, 31*b* and the stationary contact supporting parts 33*a*, 33*b* are connected with parallel resistors 44, mechanically and electrically, by means of supporting materials 34*a*, 34*b*. 68*a*, 68*b* may be another stationary contact supporting part in the case of a circuit breaker having more than 2 gaps, but in the case of only a 2-gap circuit breaker, 68*a*, 68*b* are conductors which are connected with the conductors of a bushing (which is not shown) or with a busbar (which is not shown).

The parallel resistors 44 are mechanically and electrically connected with the supporting materials 34*a*, 34*b* and are connected with a stationary contact 45. The stationary contact 45 is shielded with a shield 70 to insure a smooth electric field between the stationary contact 45 and a movable contact 46. On the other hand, the movable contact 46 is shielded with shield 72 which is mounted upon the center casing 36. A rod 47 is connected to movable contact 46 and is movable therewith. Levers 48*a*, 48*b* are pivotted at pivots 74 and connected to the rods 47. Bell-crank levers 40*a*, 40*b* are pivotted at pivots 42*a*, 42*b* and have one arm connected to rods 38*a*, 38*b*. These rods are movable with the movable contacts 30*a*, 30*b* and are guided over the supporting materials 39*a*, 39*b* during the opening and closing motion. The other arm of the bell crank levers are connected to insulating rods 41*a*, 41*b*. The rods 41*a*, 41*b* are operated by any conventional means (not shown) which may comprise a trip coil, pneumatic or hydraulic motors, a power accumulator, such as a spring or any combination thereof as known in the art. The pivots 74 mechanically interconnect the pivots 42*a*, 42*b* so that the levers 48*a*, 48*b* rotate according to the rotation of the pivots 42*a*, 42*b*. (Which is not shown but indicated with dotted lines 49).

$L_3$ is the size of the gap between the movable contact 30*a* and the stationary contact 31*a*. $L_4$ is the size of the gap between the movable contact 30*b* and the stationary contact 31*b*. The length of the stationary contacts 31*a*, 31*b* are $L_C$, $L_D$, respectively.

The distance between the stationary contact supporting part 33*a* and adjoining stationary contact supporting part 68*a* is $L_E$. The distance between the stationary contact supporting part 33*b* and adjoining stationary contact supporting part 68*b* is $L_F$.

With the arrangement shown in FIG. 3 the operation is as follows:

FIG. 3 shows the open position of the circuit breaker. To close the breaker, the insulating rods 41*a*, 41*b* are moved upwards to rotate the bell-crank lever 40*a* counter-clockwise and to rotate the bell-crank lever 40*b* clockwise by any conventional means (not shown) which may comprise a trip coil, pneumatic or hydraulic motors, a power accumulator, such as a spring or any combination thereof as is known. The movable contacts 46 of the parallel resistor interrupters MR1, MR2 are actuated by the rods 47 which are connected mechanically and electrically to the bell-crank levers 40*a*, 40*b*. During the first stage the parallel resistor interrupters MR1, MR2 close before the main interrupters close. It will be understood that the total resistance between the end terminals is equal to 2R, when the ohmic value of parallel resistor 44 is R. During the second stage, the left hand main circuit interrupter which consists of the movable contact 30*a* and the stationary contact 31*a* is closed when the insulating rod 41*a*, moves upwards further, since the distance $L_3$ is smaller than the distance $L_4$. At this stage the total resistance between the end terminals is equal to R. At the last stage the right hand main circuit interrupter which consists of the movable contact 30*b* and the stationary contact 31*b* is closed, when the insulating rod 41*b* moves upwards further. Thus the ohmic resistance between end terminals is almost 0, that is, the circuit breaker is closed.

Figure 4:
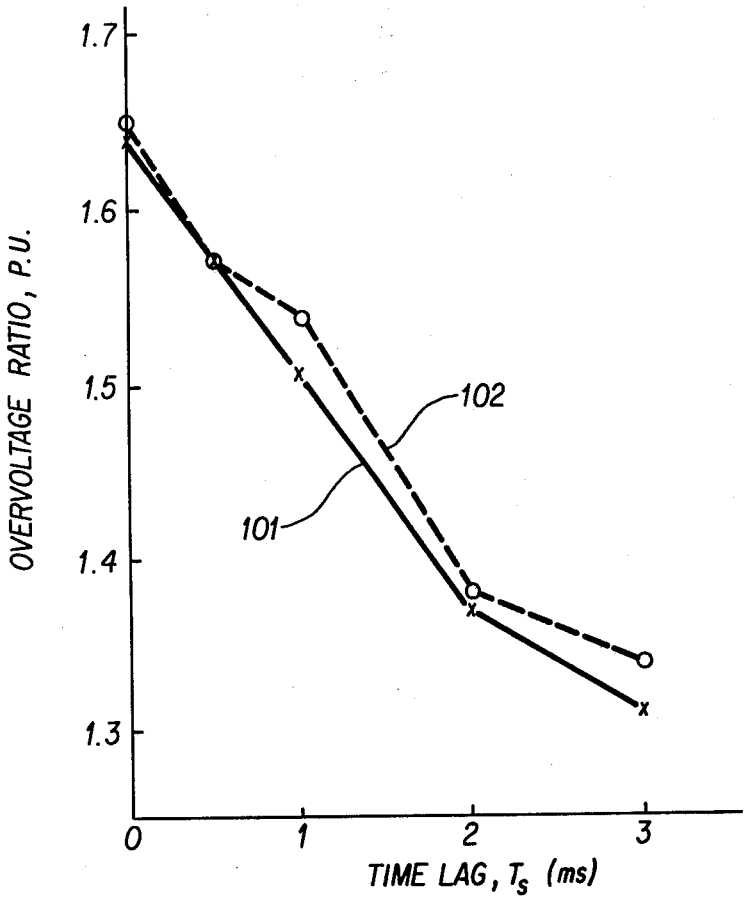
FIG. 4 is a graph which shows the relation between the closing time lag, Ts and the overvoltage ratio, P.U.

FIG. 4 shows diagrammatically the overvoltage ratio which appears on the transmission line when the circuit breaker shown in FIG. 3 is closed. The overvoltage ratio is defined as the ratio of the overvoltage to the rated voltage of the breaker. The reference Ts (units of milliseconds) on the abscissa generally designates the closing time lag between the main interrupters, owing to the different length $L_3$ and $L_4$. The reference P.U. on the ordinate generally designates the overvoltage ratio, or the voltage which appears on the transmission line when the circuit breaker is closed compared to the rated voltage.

Figure 5A:
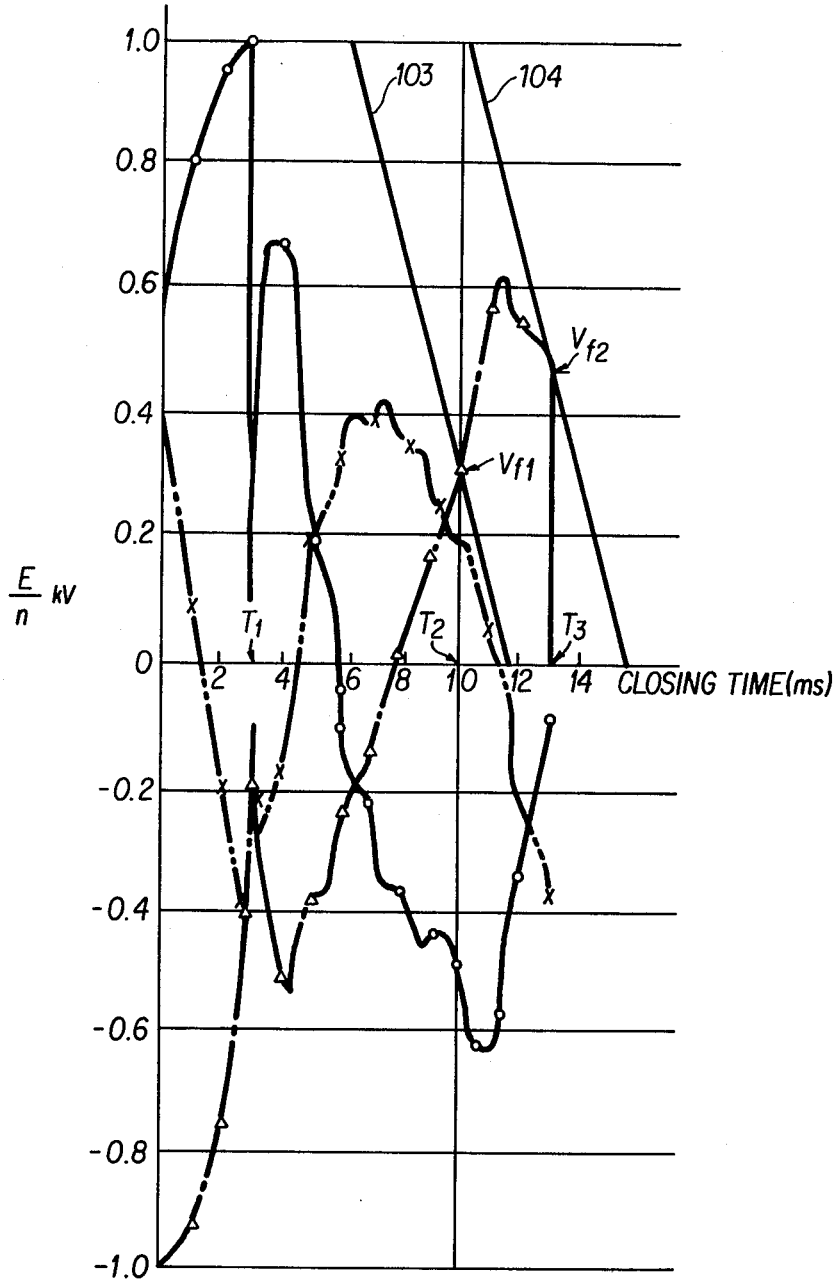
FIGS. 5(*a*) and 5(*b*) are graphs which show the relation between the withstand voltage of the parallel resistor and the voltage which appears between one of the gaps of the main interrupters.
Figure 5B:
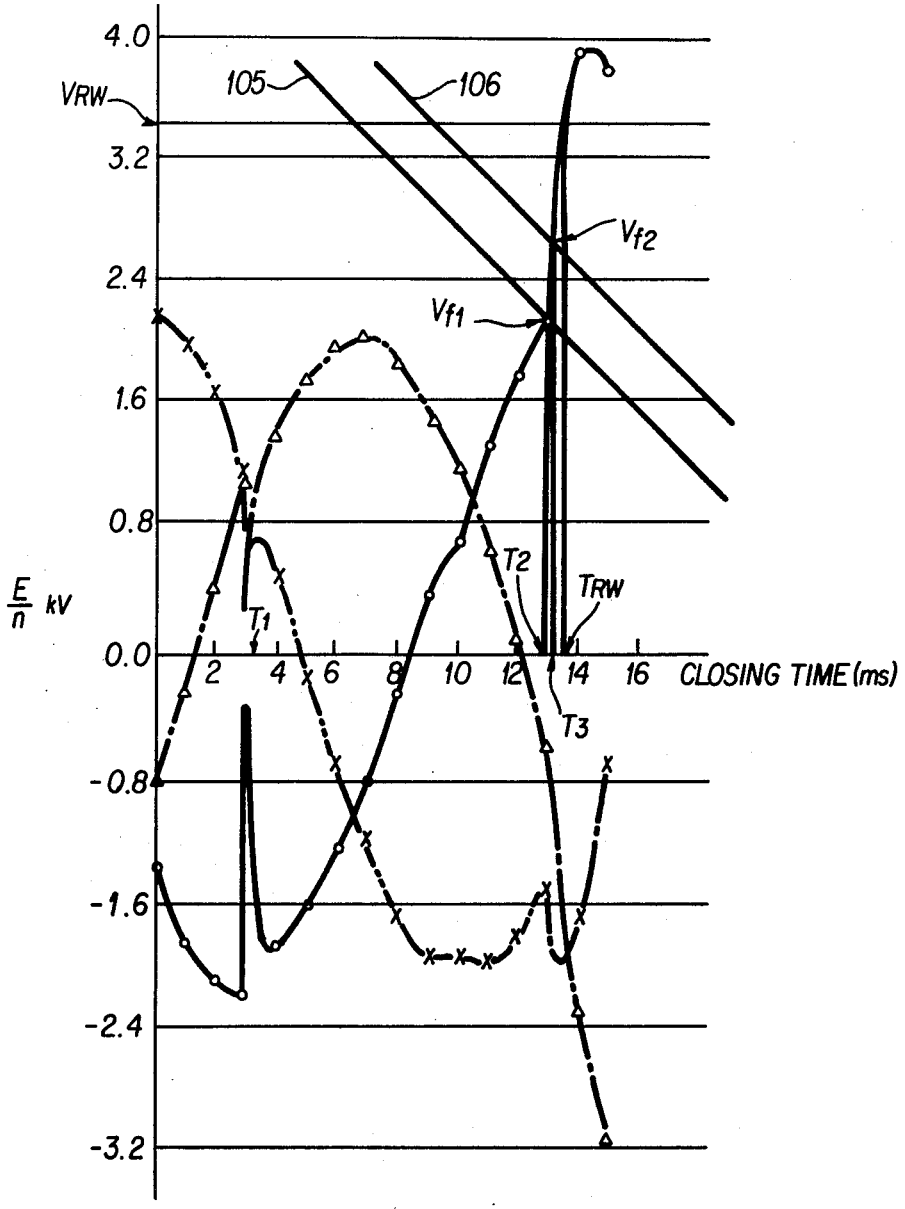

The overvoltage ratio has been calculated using the following conditions. The length of the sound transmission line is 200 kilometers. The transmission line is one circuit and is open at its end. Its positive-phase surge impedance Zs is 218 ohms. The capacitance to ground is 15000 pF/km. The source reactance estimated from the circuit breaker terminal is 35 ohms. The total ohmic value of the parallel resistors of the circuit breaker (2R) shown in FIG. 3 is 500 ohms. The maximum rated voltage is reached when the parallel resistor interrupters are closed. The transmission line may be either charged or not charged with the voltage of the power source. Under the condition that the transmission line is not charged, the overvoltage ratio is calculated to follow curve 101 shown in FIG. 4. Under the condition that the transmission line is charged with the voltage of the power source, the overvoltage ratio is calculated to follow curve 102 shown in FIG. 4. Referring to FIG. 4, it can be seen that it is possible to reduce the over-voltage effectively when the closing time lag Ts is more than 1 mS. It is necessary to meet the following conditions in order to set the closing time lag Ts to be more than 1 mS considering the pre-arc between the main circuit interrupters, when the circuit is connected to the power supply:

The capacitance to ground of the transmission line is 15000 pF/km. The pressure of the $SF_6$-gas in the tank to which the circuit breaker is connected is 6 kg per square centimeter. The following equation is true when the arc-discharging characteristics are as shown in FIG. 5(*a*):

$$Ls \geqq v + 0.068\frac{E}{n}\cdot\frac{kZs}{\sqrt{(kZs)^2 + \frac{4.5\times 10^{10}}{Ll^2}}} \quad (1)$$

where $L_s$ is the difference between the longest and shortest distance between the stationary contact and the movable contact. (For example in case of FIG. 3 $Ls = L_4 - L_3$.)

v is the final velocity of the movable contact shortly before the main interrupters are closed.

Zs is the positive phase surge impedance of the transmission line.

k is the ratio of the total value of resistance between the end terminals to the positive phase surge impedance of the transmission line, i.e. k=R/Zs. phase.

Ll is the length of the transmission line.

E is the peak value of the rated voltage on the transmission line.

It is necessary to meet the following condition in order to protect the parallel resistor from overvoltage when the circuit breaker is closed and circuit is out of phase. In the case when the big power circuit is out of phase, the impedance of the circuit is small. The total value of the parallel resistance between the end terminals is normally more than the value of positive phase surge impedance Zs of the transmission line. Accordingly, the total value of the voltage 2E is charged upon the parallel resistor. The parallel resistor can bear voltage more than 1.7E during a time smaller than 500 $\mu$S, because the withstand voltage of the parallel resistor is designed to bear a voltage greater than 2E.

FIG. 5(*b*) shows the relation between the voltage charged upon one main interrupter or one parallel resistor, and the closing time of the parallel resistor interrupters or the main interrupters when the circuit breaker is closed and circuit is out of phase. In order to set the closing time lag to be more than 1 mS under the condition that the arc-discharging characteric is showed in FIG. 5(*b*), the following condition must be met:

$$Ls < 0.127E/n \quad (2)$$

The total resistance, R, of the parallel resistor should meet the following condition in order to reduce the overvoltage when the circuit breaker is closed:

$$Zs \leqq R \leqq 3Zs \quad (3)$$

Zs normally meets the following condition:

$$180 \text{ ohms} < Zs < 300 \text{ ohms} \quad (4)$$

From the formulas 1–4, the maximum closing velocity of the movable contact of main circuit interrupter is as follows:

$$v \leqq 0.059E/n$$

FIG. 5(*a*) shows the relation between the voltage charged upon a main interrupter and the closing time when a sound three phase circuit which is not charged and having a length of 200 km is connected to the energy supply by the circuit breaker. $T_1$ on the abscissa is the closing time of the parallel resistor interrupter. $T_2$ on the abscissa is the closing time of the first group of the main interrupters which close first. $T_3$ on the abscissa is the closing time of the second group of the main interrupters which close last. The voltage which is charged on one of the main interrupters is shown on the ordinate. The solid line (sign O) describes the phase A-circuit-breaker. The dotted line (sign Δ) describes the phase B-circuit-breaker. Another dotted line (sign X) describes the phase C-circuit-breaker.

$V_{f1}$ designates the voltage which is charged upon the main interrupter of the phase B circuit breaker when the main interrupter is closed by pre-arc at the time $T_2$. $V_{f2}$ designates the voltage which is charged upon the main interrupter of the phase B circuit breaker when the main interrupter is closed by pre-arc at the time $T_3$. The line 103 shows the characteristics of the withstand voltage which is charged upon the main interrupter which is closed by pre-arc at the time $T_2$ or which belongs to the first group. The line 104 shows the characteristics of the withstand voltage which is charged upon the main interrupter which is closed by pre-arc at the time $T_3$ or which belongs to the second group. It was previously stated that it is necessary to set the closing time lag between the first main interrupter for example MC1 in FIG. 3 and the second main interrupter, for example MC2 in FIG. 3, to be more than 1 mS. For a device having more than 2 interrupters, it is only necessary that the time lag between any one of the main interrupters be more than 1 mS. For example, 1 mS can be the time lag between the first and second interrupter or the first and last interrupter.

In the case shown in FIG. 5(*a*), the closing time lag $(T_3-T_2)$ is 3 mS, the closing velocity of the movable contact of the main interrupter v is 1.5 m/S and the difference between the gap of main interrupters $L_3$ and $L_4$ in FIG. 3 or Ls is 6 mm.

In the case shown in FIG. 5(*b*), the circuit is out of phase. At the time $T_1$, the resistor interrupter is closed; at the time $T_2$ the first main interrupter is closed and then at the time $T_3$ the second main interrupter is closed.

The time is shown on the abscissa and the voltage which is charged upon one of the main interrupters is shown on the ordinate. The circuit length of this case is 1500 km and the two circuits are connected to the same power station in parallel and run either over the same place or over a different place.

The relation between the closing time and the withstand voltage of the phase A-circuit breaker is shown by the solid line (sign O). That of the phase B-circuit breaker is shown by the dotted line (sign Δ). That of the phase C-circuit breaker is shown by the another dotted line (sign X).

$V_{f1}$ designates the voltage which is charged upon the first main interrupter when it is closed by pre-arc at the time $T_2$. $V_{f2}$ designates the voltage which is charged upon the second main interrupter when it is closed by pre-arc at the time $T_3$. The line 105 shows the characteristic of the withstand voltage which is charged upon the first main interrupter. The line 106 shows the characteristic of the withstand voltage which is charged upon the second main interrupter. $V_{RW}$ designates the limited withstand voltage value of the parallel resistor. After the first main interrupter is closed, the second main interrupter should be closed by pre-arc before the voltage which is charged upon the parallel resistor (shown with the sign O) exceeds the value $V_{RW}$. $T_{RW}$ on the abscissa shows the time when the voltage between the gap of one of the main interrupters reaches the limited voltage value or $V_{RW}$. Before this time or $T_{RW}$, the second main interrupter should be closed by pre-arc.

Referring to FIG. 5(*b*), at the time $T_3$ the second main interrupter is closed. The time lag between $T_{RW}$ and $T_3$ is set up 0.4 mS. The velocity of the movable contact of the main interrupter v is 1.5 m/S and the difference between the gaps of the main interrupters $L_3$ and $L_4$ in FIG. 3 is 6 mm, in this case.

The maximum voltage value which is charged upon the parallel resistor is 1.35 times as much as the limited withstand voltage value of the rated frequency. According to the "ULTIMATE POWER FREQUENCY AND IMPULSE PERFORMANCE, BM4 MATERIAL" chart which was published Apr. 17, 1979 by MORGANITE Co, it is preferable for the parallel resistor that the aforementioned margin is 1.7.

Figure 6:
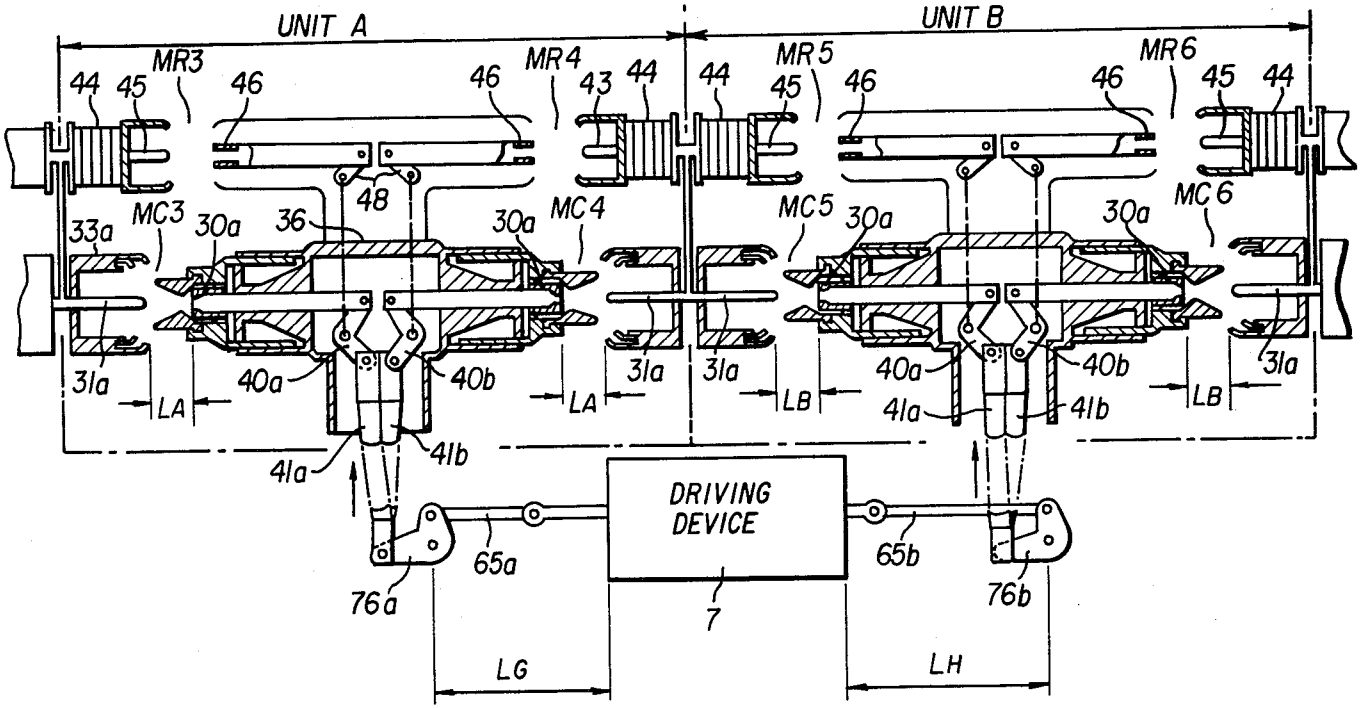
FIG. 6 is a sectional view of another embodiment of a multi-gap circuit breaker in accordance with the present invention.

Referring to FIG. 6, there is shown another embodiment of the multi-gap circuit-breaker, the same parts being given the same reference numerals. In this embodiment the main interrupters MC3, MC4 and the parallel resistor interrupters MR3, MR4 belong to the unit A and the main interrupters MC5, MC6 and the parallel resistor interrupter MR5, MR6 belong to the unit B. The gap between stationary contacts 31*a* and movable contacts 30*a* of the main interrupters of the unit A is $L_A$ and the gap between stationary contacts 31*a* and movable contacts 30*a* of the main interrupters of the unit B is $L_B$. $L_A$ is longer than $L_B$ and the difference between the gaps of the main interrupters of the units A and B is $(L_A-L_B)$ or Ls. Ls is so arranged that the closing time lag between the units A and B is more than 1 mS. 7 designates a driving device which operates the main interrupters and the parallel resistor interrupters of the units A and B.

The movable contacts 46 of the parallel resistor interrupters MR3–MR6 and the movable contacts 30*a* of the main interrupters MC3–MC6 are mechanically interconnected by means or a plurality of insulating rods 41, bell-crank levers 76*a*, 76*b* and the operating rods 65*a*, 65*b*. They are so arranged that the main interrupters MC3–MC6 will close at times separated by more than 1 mS. In case the number of units is more than 2, the difference between the maximum gap and minimum gap of the main interrupters is set up to be Ls.

In this case too, the main interrupters are arranged so that a plurality of units will close at different moments of time, with the difference being more than 1, mS.

In the embodiments of both FIG. 3 and FIG. 6, the differences between the gaps of the main interrupters can be created in different manners. Referring to FIG. 3, the distances between the movable contacts 30*a*, 30*b*, and the opposite end of the stationary contact 31*a*, 31*b*, or the point at which the stationary contacts 31*a*, 31*b* come together with the stationary contact supporting parts 33*a*, 33*b* is constant. Accordingly, the distance $(L_3+L_c)$ is equal to the distance $(L_4+L_D)$. The different length of the stationary contacts 31*a*, 31*b* results in different gaps of the main interrupters MC1, MC2. The merit of this embodiment is that all parts of the main interrupters MC1, MC2 other than the stationary contacts 31*a*, 31*b* are common.

It is also possible to vary the length of the supporting materials 34*a*, 34*b* so that they differ from each other. This also results in the different gaps of the main circuit interrupters MC1, MC2.

Further, referring to FIG. 6, the alternation of the link ratio of the bell-crank levers 40*a*, 40*b*, 76*a*, 76*b*, or the differing length of the insulating rods 41*a*, 41*b* and/or the actuating rods 65*a*, 65*b* result in the different gaps of the main interrupters.

An example of this condition is as follows. Supposing that the difference between the length of the operating rods 65*a*, 65*b* or $L_G$, $L_H$ is longer by $L_c$ then the difference between them when the gaps of the main interrupters are the same; Ls is so arranged that the closing time lag between the first main interrupters and the last main interrupters is more than 1 ms, then Ls and Lc meet the following condition:

$$Lc = \frac{Ls}{\nu_1 \cdot \nu_2}$$

where $\nu_1$ is the ratio of the bell-crank lever 40a, 40b and $\nu_2$ is the ratio of the bell-crank lever 76a, 76b.

Furthermore, supposing that the difference between the length of the insulating rods 41a, 41b is $L_1$; Ls and $L_1$ meet the following condition:

$$L_I = \frac{Ls}{\nu_1}$$

where $\nu_1$ is the same as set forth above.

Furthermore, supposing that the gaps of the main circuit interrupters are the same and the velocity of the movable contacts of the main interrupter are different, resulting in the main interrupters closing at slightly different moments of time. In this case, the velocity of the movable contacts of the main interrupters should be less than or equal to 0.059 E/n meter per second just before the main interrupters are closed, where E represents the peak value against ground of the rated voltage and n is the number of the main interrupters.

It is seen that the main circuit interrupters are so arranged that they close at slightly different moments of time by the aforementioned means. But it can be inevitable that the main circuit interrupter will open at slightly different moments of time, too when the interrupters are interconnected with each other.

It is inevitable that the main and/or the parallel resistor interrupters will open and close at slightly different moments of time, and in order to remove this default, resistors of high ohmic value are inserted in parallel with the circuit interrupters between the main and parallel resistor interrupters. This invention utilizes the fact that the main interrupters close at different moments of time to an advantage.

In case the parallel resistor interrupters open after the main circuit interrupters are closed, the overvoltage does not appear across the parallel resistors when the main circuit interrupters open. But in case the parallel resistor interrupters open just before the main circuit interrupters open, the overvoltage appears across the parallel resistor when the main circuit interrupters open.

The closing velocity of the movable contact is normally smaller than the opening velocity, that is, the opening time lag is smaller than the closing time lag. Therefore it is almost no problem that the main interrupter will open at slightly different moments of time in order to close at different moments of time, according to the invention.

The circuit breaker according to this invention can suppress the overvoltage which appears on the transmission line when it is connected. Therefore it is possible that the dielectric level of the circuit breaker may be reduced, reliability of the circuit is improved, and the apparatus becomes less expensive.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit breaker comprising:

a series connection of plural main interrupters connected in series between end terminals;

a plurality of parallel resistors;

a plurality of parallel interrupters, each of said parallel interrupters connected in series with a respective of said plurality of parallel resistors between said end terminals;

said series connection of main interrupters being connected in parallel with said parallel interrupters connected in series with said respective of said parallel resistors;

driving means for providing power to operate said main interrupters and said parallel interrupters;

connecting means attached to said main interrupters, said parallel interrupters and said driving means for transmitting the power of said driving means to operate said main interrupters and said parallel interrupters;

wherein said connecting means, said main interrupters and said parallel interrupters are configured so as to close said parallel interrupters before any of said main interrupers and to close at least one of said main interrupters at a time different than a time of closing of another of said main interrupters by at least 1 millisecond but less than or equal to 3 milliseconds.

2. A circuit breaker as claimed in claim 1 wherein said main interrupters each include a movable contact, a stationary contact, and a gap between said movable contact and said stationary contact, wherein at least one of said main interrupters has a gap different in size than that of at least one other main interrupter.

3. A circuit breaker as claimed in claim 2, wherein the velocity of said movable contact of said main interrupters is less than or equal to 0.059 E/n meters per second at the time of closing of said main interrupters where E equals the peak value of kilovolts of the rated voltage compared to ground and n equals the number of main interrupters.

4. A circuit breaker comprising:

a plurality of units with each unit comprising:

a series connection of plural main interrupters connected in series between end terminals;

a plurality of parallel resistors;

a plurality of parallel interrupters, each of said parallel interrupters connected in series with a respective of said plurality of parallel resistors between said end terminals;

said series connection of main interrupters being connected in parallel with said parallel interrupters connected in series with respective of said parallel resistors;

wherein said units are connected in series with the end terminals of adjacent units being connected;

driving means for providing power to operate said main interrupters and said parallel interrupters of said plurality of units;

connecting means attached to said main interrupters, said parallel interrupters and said driving means for transmitting the power of said driving means to operate said main interrupters and said parallel interrupters;

wherein said connecting means, said main interrupters and said parallel interrupters are configured as to close said parallel interrupters of each unit before the main interrupters of each unit, and to close the main interrupters of each unit at a different time than the main interrupters of different units such that at least one of said units has a time between the closing of the main interrupters thereof at a time different that a time of closing of the main interrupters of another of said units by at least 1 millisecond but less than or equal to 3 milliseconds.

5. A circuit breaker as claimed in claim 4 wherein said main interrupters each include a movable contact, a stationary contact, and a gap between said movable contact and said stationary contact, wherein the gaps of the main interrupters of at least one of said units is different in size than the gaps of at least one of said main interrupters of another of said units.

6. A circuit breaker as claimed in claim 5, wherein the velocity of said movable contact of said main interrupters is less than or equal to 0.059 E/n meters per second at the time of closing of said main interrupters where E equals the peak value in kilovolts of the rated voltage compared to ground and n equals the number of main interrupters.

* * * * *